US005419167A

United States Patent [19]

Yamada et al.

[11] Patent Number: 5,419,167

[45] Date of Patent: May 30, 1995

[54] DOOR GRIP ASSEMBLY

[75] Inventors: Kenichi Yamada, Tokyo; Takashi Itou, Higashioosaka, both of Japan

[73] Assignee: Takigen Manufacturing Co., Ltd., Tokyo, Japan

[21] Appl. No.: 95,675

[22] Filed: Jul. 21, 1993

[30] Foreign Application Priority Data

Aug. 17, 1992 [JP] Japan ..... 4-063097 U

[51] Int. Cl.[6] ..... E05B 13/10

[52] U.S. Cl. ..... 70/208; 70/84; 70/224; 70/451; 70/462; 292/166; 292/DIG. 31

[58] Field of Search ..... 70/67, 69–73, 70/78, 84, 120, 123, 208–210, 215–217, 224, 448, 450–452, 461, 462, 466, DIG. 67; 292/DIG. 31, DIG. 53, DIG. 54, 336.3, 30, 35, 166, 223, 227

[56] References Cited

U.S. PATENT DOCUMENTS

| | | | |
|---|---|---|---|
| 1,723,020 | 8/1929 | Erwin | 70/72 |
| 3,584,483 | 6/1971 | Orr | 70/208 X |
| 4,129,019 | 12/1978 | Urdal | 70/462 X |
| 4,134,281 | 1/1979 | Pelcin | 70/208 |
| 4,177,656 | 12/1979 | Davis | 70/84 |
| 4,231,597 | 11/1980 | Pelcin | 70/208 X |
| 4,294,089 | 10/1981 | Best et al. | 70/448 X |
| 4,438,964 | 3/1984 | Peters | 70/208 X |
| 4,554,807 | 11/1985 | Dolejs | 70/208 |
| 4,841,755 | 6/1989 | Weinerman et al. | 70/208 |
| 4,850,209 | 7/1989 | Weinerman et al. | 70/451 X |
| 4,882,919 | 11/1989 | Craig | 292/DIG. 31 X |
| 4,892,338 | 1/1990 | Weinerman et al. | 292/DIG. 31 X |
| 5,011,202 | 4/1991 | Kato et al. | 292/DIG. 31 X |
| 5,127,686 | 7/1992 | Gleason et al. | 70/208 X |
| 5,340,174 | 8/1994 | Bender et al. | 70/466 X |
| 5,347,834 | 9/1994 | Ramsauer | 70/208 X |

FOREIGN PATENT DOCUMENTS

| | | | |
|---|---|---|---|
| 369403 | 3/1939 | Italy | 70/208 |
| 6801119 | 8/1968 | Netherlands | 70/208 |

*Primary Examiner*—Peter M. Cuomo
*Assistant Examiner*—Suzanne L. Dino
*Attorney, Agent, or Firm*—Martin Smolowitz

[57] ABSTRACT

A door grip assembly comprises a grip having a vertical sleeve-like member elastically fitted in bearing grooves of a grip casing and also having increased diameter portions engaged with walls of the grip casing, an angular drive bar inserted through angular through bores of the vertical sleeve-like member, a latch support having a base fitted in opposed L-shaped pawls in one of pawl pairs each provided on each end of top and bottom portions of a base plate member having a front central portion thereof engaged with an intervening portion between the opposed L-shaped pawls, the base plate also having an integral tongue portion having an end projection elastically fitted in a hole formed in the intervening portion, and a vertical round bar having an upper jaw and a lower jaw engaged with wall portions of the latch support, and a vertical round bar provided with an upper and a lower angular hole defined by a partitioning wall, opposite ends of the angular drive bar being fitted in the angular holes.

The assembly permits locking of various components by a simple fitting operation and also permits great simplification and cost reduction for assembling the door grip.

7 Claims, 9 Drawing Sheets

DOOR GRIP ASSEMBLY

BACKGROUND OF THE INVENTION

1. Field of the Invention

This invention relates to a door grip assembly of a lock-in type to lock a door in a business cabinet or like stationary frame.

2. Prior Art

In a prior art door grip assembly, a grip casing is secured to a base member which is secured to the rear surface of a door, a vertical bar is inserted through a vertical bore in a grip stem and a hole in a grip casing wall, an E or C-shaped lock ring is fitted in a peripheral groove of the vertical rod, an angular drive bar is inserted through a vertical through bore formed in the vertical bar, a lock pin is driven into the vertical and angular drive bars, a latch support is secured by a screw to the base member, a vertical round bar of the latch is inserted through a vertical bore of the latch support, and E or C-shaped lock pin is fitted in a peripheral groove of the vertical round bar.

However, such prior art door grip assembly, which is obtained by locking the vertical bar of the grip, vertical round bar of the latch and the angular drive bar with the E or C-shaped ring and the lock pin and also securing the latch support to the base member with the screw, requires many assembling steps, thus leading to a high cost of assembling. Therefore, it is difficult to reduce the manufacturing cost.

In another aspect, the doors which are hinged to a stationary body belong to one of two types, i.e., a right opening type in which the hinge pin is on the left side while a stationary frame side counterpart member is on the right side, and a left opening type in which the hinge pin is on the right side while the counterpart member is on the left side. However, in the prior art door grip assembly the grip casing and latch support are disposed fixedly with respect to the base member. Therefore, it is necessary to provide exclusive door grip assemblies for the right and left opening type doors, thus making it impossible to save the manufacturing cost by mass production of assemblies of a single type.

Besides, stocking door grip assemblies of the two different types dictates much shelf space. Further, it is necessary to check the type of each assembly when the assembly is sold, that is, the selling stage is cumbersome and liable to erroneous delivery.

SUMMARY OF THE INVENTION

An object of the invention, accordingly, is to provide a door grip assembly, in which locking of individual components can be done by simple fitting operations, thus permitting simplification of the assembling and reduction of the manufacturing cost.

Another object of the invention is to provide a door grip assembly, which can be used for both the left and right opening doors by alteration of the assembling process, thus permitting reduction of the manufacturing cost by mass production of a single type, reduction of the shelf space and dispensing with the type check at the time of selling.

To attain the above objects of the invention, there is provided a door grip assembly, which comprises a grip casing secured to a base plate member secured to the rear surface of a door, a grip having a vertical sleeve-like member elastically fitted in bearing grooves each formed in an upper and a lower wall portion of the grip casing, the vertical sleeve-like member having opposite end increased diameter portions engaged with the upper and lower wall portions, an angular drive bar inserted through a vertical through angular bore formed in the vertical sleeve-like member, the base plate member having pawl pairs each provided on each end of a top and a bottom portion of its rear surface, each pawl pair consisting of opposed L-shaped pawls sandwiching an intervening portion having a forward/rearward hole, a latch support having a base portion having left and right edge portions fitted in the opposed L-shaped pawls and also having a front central surface engaged with the intervening portion, the base portion having an integral tongue portion having an end projection elastically fitted in the hole in the intervening portion, a latch having a hook capable of being hooked on and unhooked from a counterpart member on the side of a frame of the door, the latch having a stem having a vertical round bar elastically fitted in vertical through grooves formed in an upper and a lower wall portion of the latch support, the vertical round bar having an upper and a lower jaw engaged with the wall portions of the latch support, the hook being biased by a spring for rotation in a direction of hooking of the hook on the counterpart member, the vertical round bar of the latch having an upper and a lower angular hole defined by a partitioning wall, opposite ends of the angular drive bar being fitted in the angular holes.

With this structure, there is no need of locking the vertical sleeve-like member of the grip, the vertical round bar of the latch and the angular drive bar by using an E or C-shaped ring or a locking pin, and also there is no need for securing the latch support to the base plate member with the screw. It is thus possible to greatly simplify the assembling of the door grip assembly and reduce the manufacturing cost thereof.

According to the invention, there is also provided a door grip assembly, in which the grip can be mounted in one form and also in a transversally reversed form on the base member.

Thus, the door grip assembly according to the invention can be directly used for a right opening type door, in which the hinge pin is on the left side while the counterpart member of the frame is on the left side, and also used for a left opening type door, in which the hinge pin is on the right side while the counterpart member of the frame is on the left side, by selecting either of the two ways of mounting the door grip assembly.

According to the invention, there is further provided a door grip assembly, which further comprises an additional base member secured to the door in correspondence to the size of the door, the additional base member having a pawl pair consisting of opposed L-shaped pawls sandwiching an intervening portion having a forward/rearward hole. The locking of the door with the hook and counterpart member thus can be obtained at a desired number of positions spaced apart at a desired interval by securing one or more additional base members in correspondence to the size of the door.

According to the invention, there is further provided a door grip assembly, which further comprises a lock secured to an intermediate portion of the base plate member and having a rotor projecting rearwardly of the base plate member, an operating member secured to the rotor such as to be rotated parallel to the base plate member, a left and a right rearwardly projecting guide having transversal through holes, a transversally elongate lock member slidably fitted in the transversal through holes, and an interlock pin having a front end portion fitted in a longitudinal slot of the operating member, a rear end portion fitted in a longitudinal slot of the operating member and an intermediate jaw clamped between the operating member and the lock member, the lock member having a locking portion projecting from its front surface, the locking portion having a transversal locking groove for engagement and disengagement with respect to the angular drive bar.

With this lock structure, the door having been locked by the engagement between a counterpart frame member and hook can, if necessary, be locked regularly with respect to the frame member.

DETAILED DESCRIPTION OF THE PREFERRED EMBODIMENTS

Figure 1:
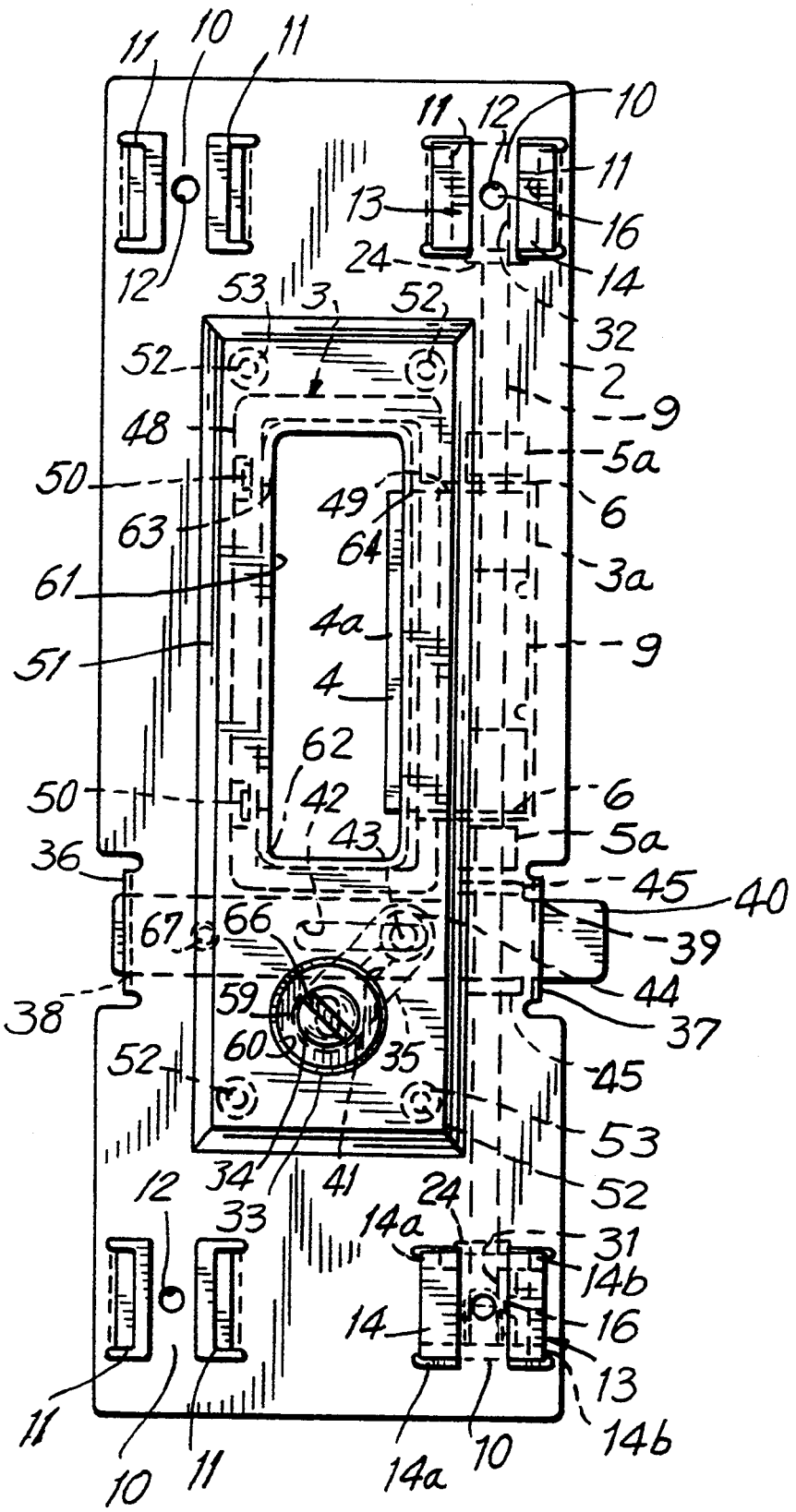
FIG. 1 is front view showing an embodiment of the door grip assembly according to the invention in a locked state.
Figure 2:
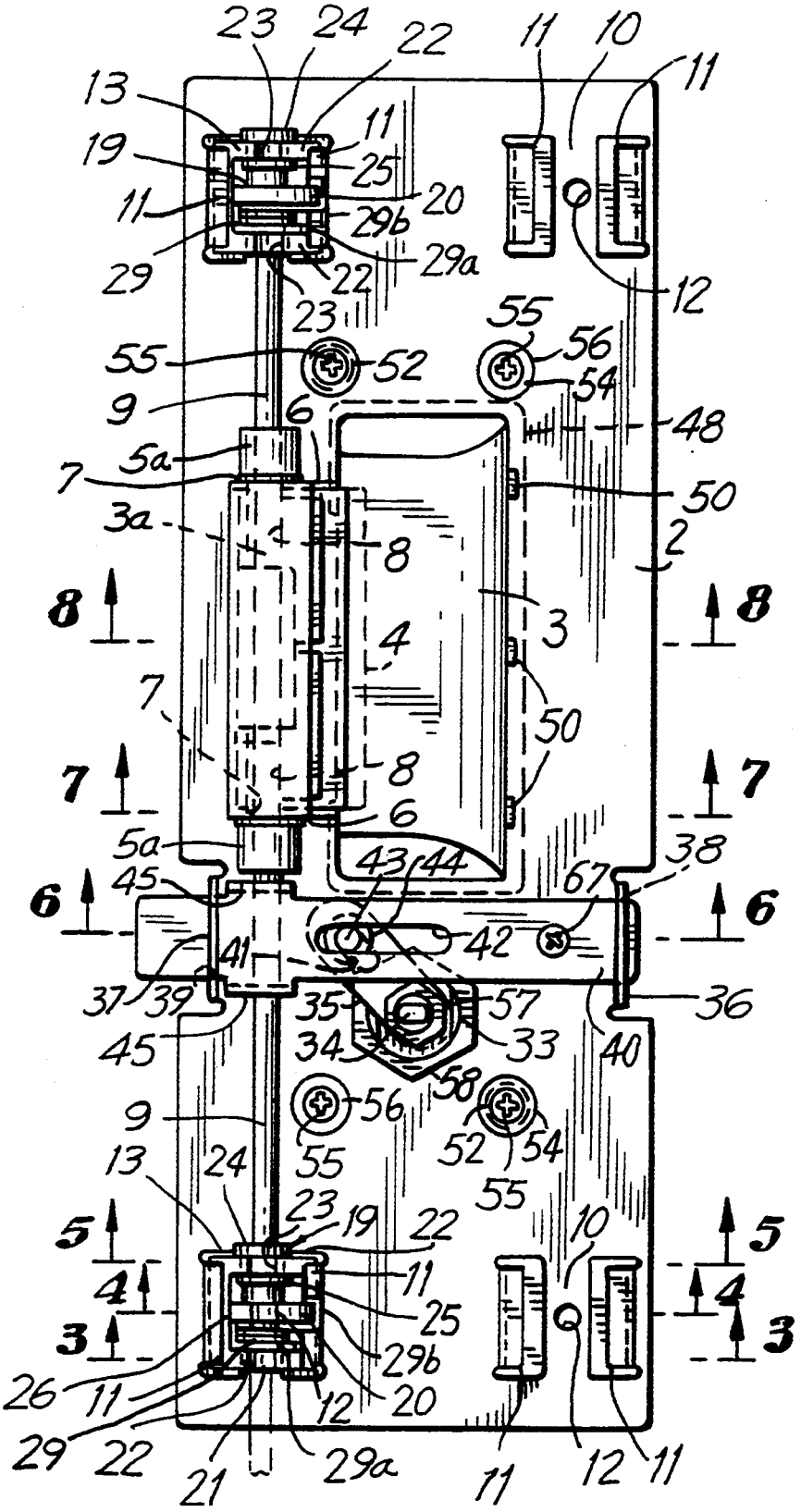
FIG. 2 is a back view of the same door grip assembly.
Figure 3:
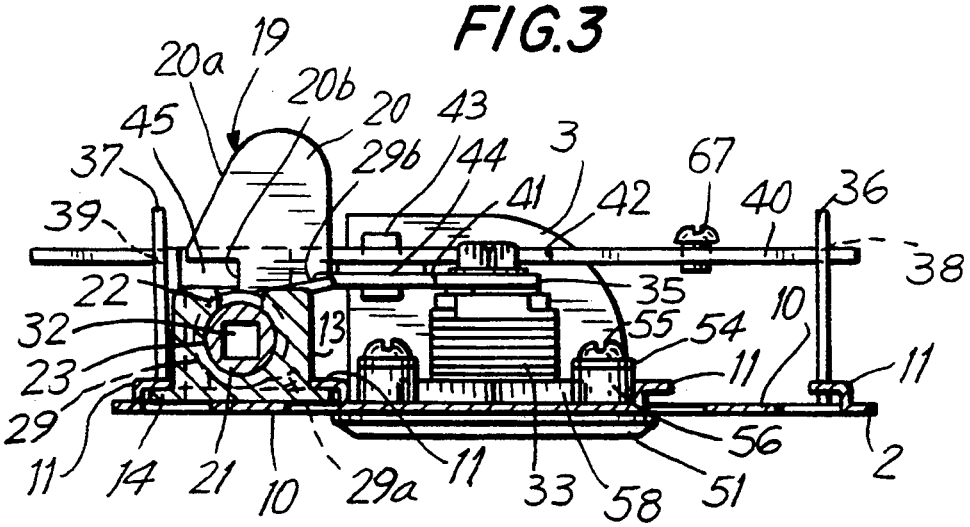
FIG. 3 is a sectional view taken along line 3—3 in FIG. 2.
Figure 4:
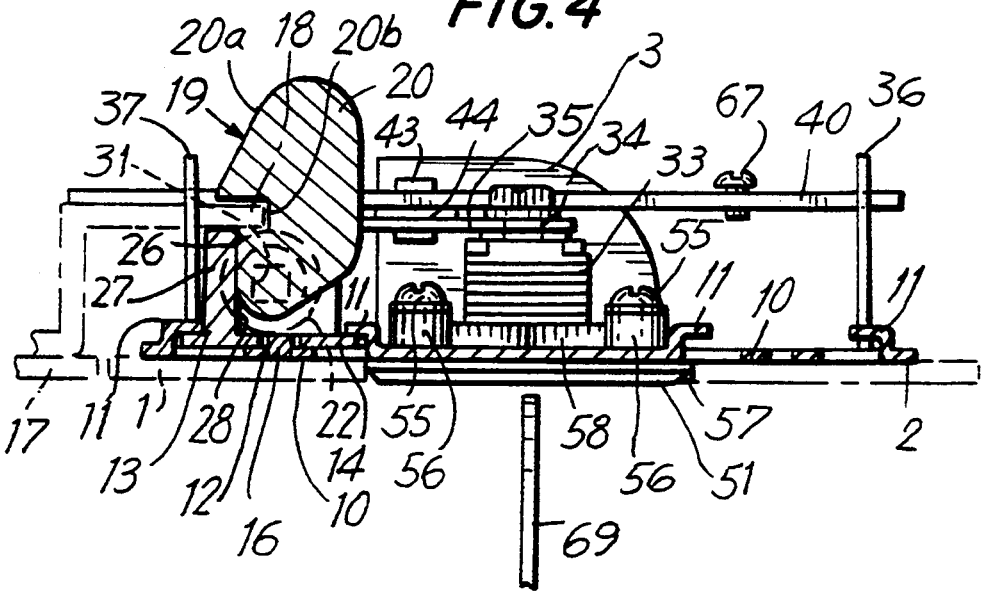
FIG. 4 is a sectional view taken along line 4—4 in FIG. 2.
Figure 5:
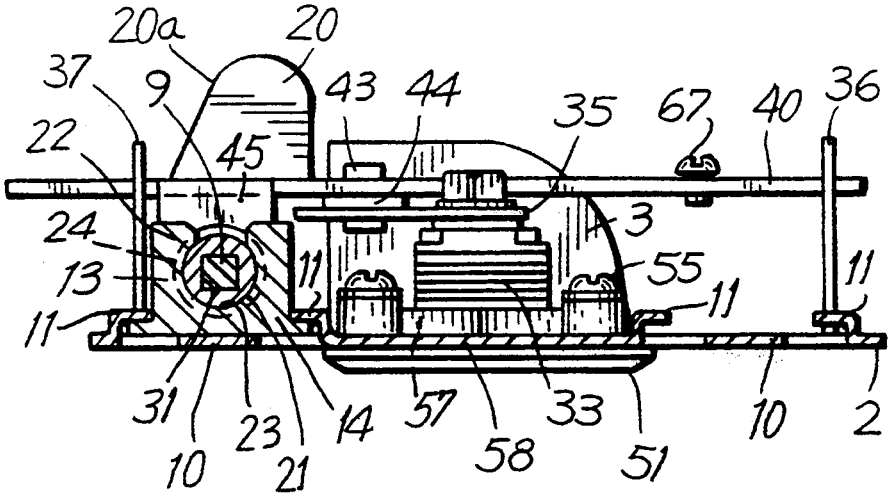
FIG. 5 is a sectional view taken along line 5—5 in FIG. 2.
Figure 6:
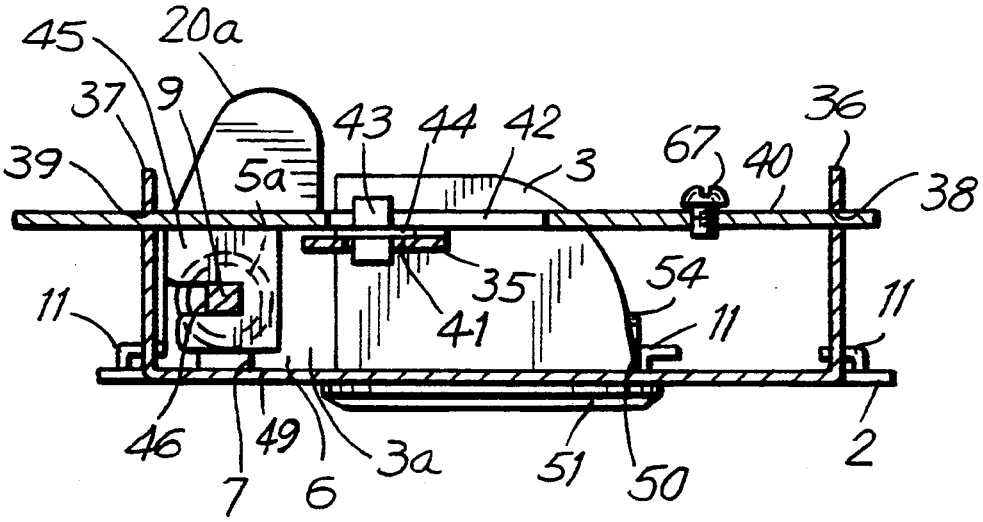
FIG. 6 is a sectional view taken along line 6—6 in FIG. 2.
Figure 7:
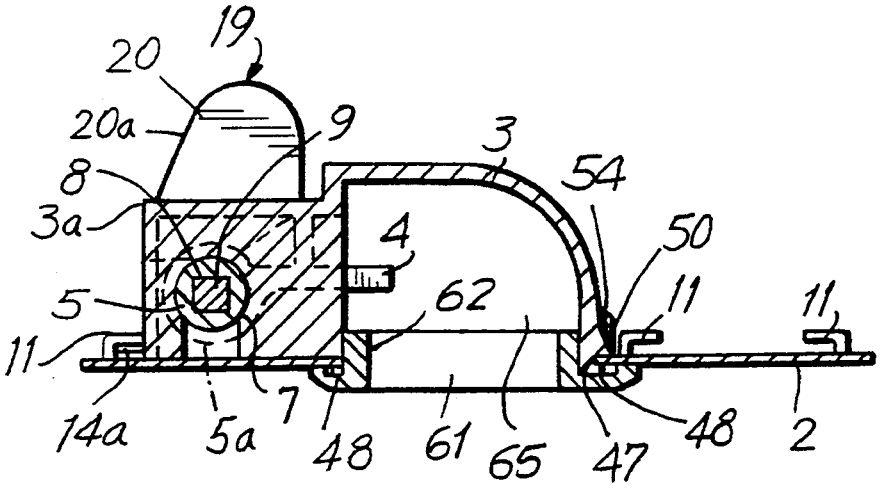
FIG. 7 is a sectional view taken along line 7—7 in FIG. 2.
Figure 8:
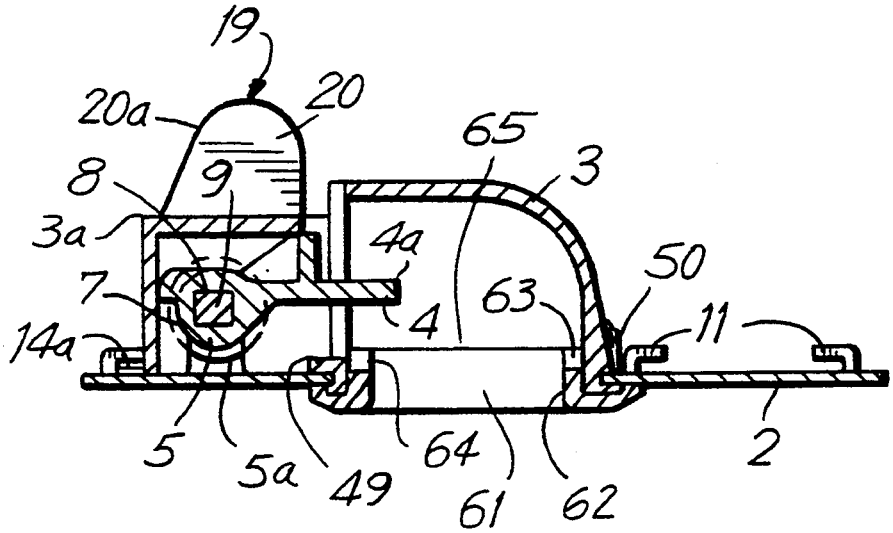
FIG. 8 is a sectional view taken along line 8—8 in FIG. 2.
Figure 9:
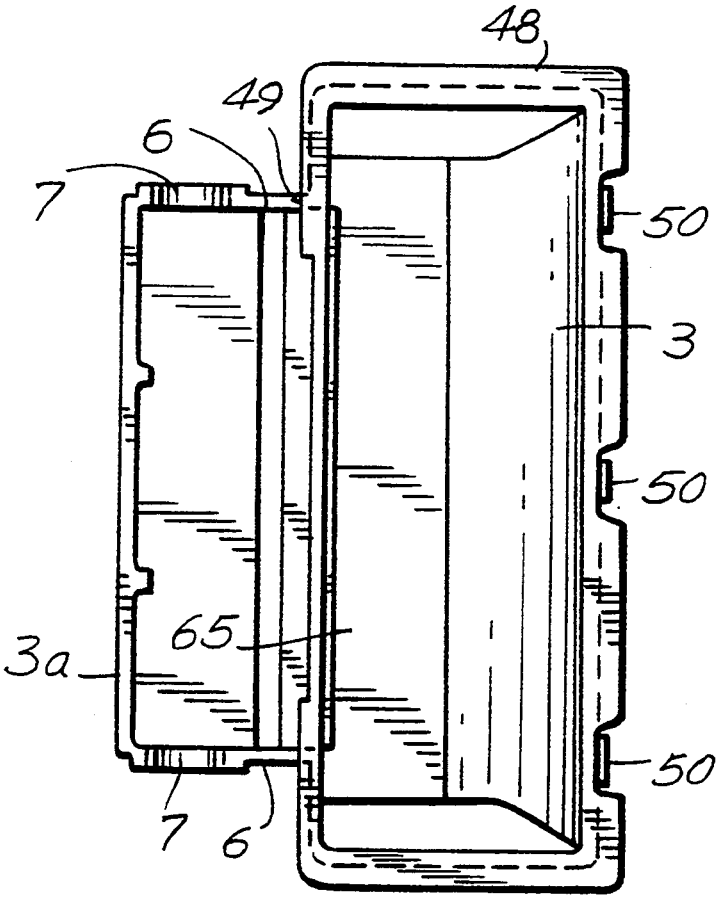
FIG. 9 is a front view showing a grip casing of the same door grip assembly.
Figure 10:
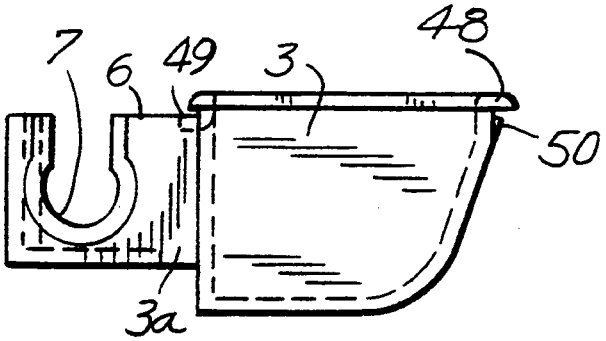
FIG. 10 is a bottom view showing the same door grip casing.
Figure 11:
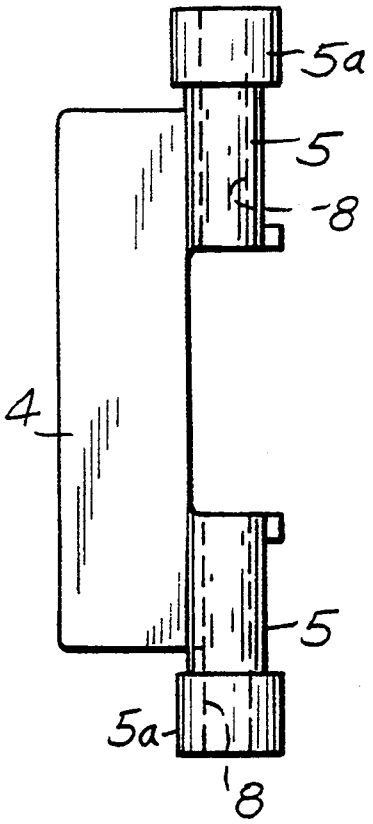
FIG. 11 is a front view showing a grip member.
Figure 12:
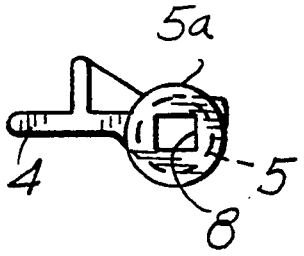
FIG. 12 is a bottom view of the same grip member.

Now, an embodiment of the door grip assembly according to the invention will be described with reference to the drawings. Referring to the Figures, secured to the rear surface of a door 1 is a base plate 2 there. To the base plate 2 is secured a grip casing 3, which has an upper and a lower wall 6 with pair of bearing grooves 7 formed therein. Designated at 4 is a grip having a vertical sleeve-like member 5 which is elastically fitted in the bearing grooves 7. The vertical sleeve-like member 5 has opposite end increased diameter portions 5*a* engaged with the walls 6 of the casing 3, and has a vertical through angular bore 8, which is penetrated by an angular drive bar 9.

Figure 13:
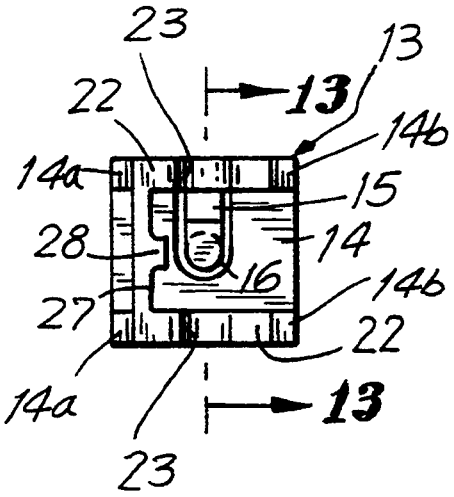
FIG. 13 is a front view showing a latch support.
Figure 14:
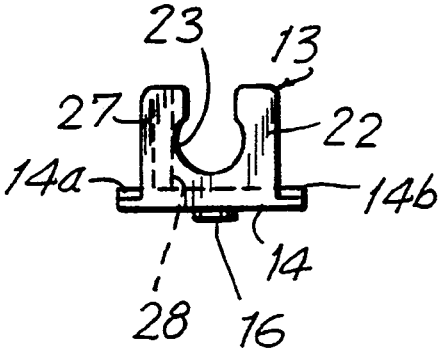
FIG. 14 is a bottom view showing the same latch support.
Figure 15:
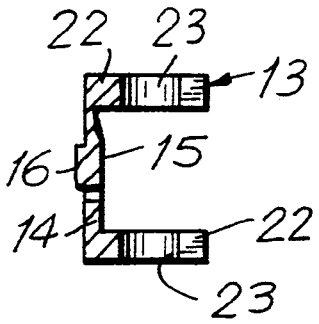
FIG. 15 is a sectional view taken along line 15—15 in FIG. 13.

The base plate member 2 has pawl pairs each provided on each end portion at a top and a bottom portion of its rear surface. Each pawl pair has opposed L-shaped pawls 11. A portion 10 intervening between the pair L-shaped pawls 11 has a hole 12 extending through the base plate 2. Designated at 13 is a latch support having a base member 14 having left and right edge portions thereof fitted in the L-shaped pawls 11 of either of the upper pawl pairs. The base member 14 has a front central surface engaged with the intervening portion 10. It has an integral tongue portion 15, the free end of which has a projection 16 elastically fitted in the hole 12 in the intervening portion 10 (see FIGS. 13–15).

Figure 16:
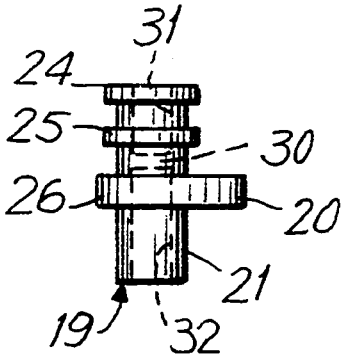
FIG. 16 is a front view showing a hook of the latch.
Figure 17:
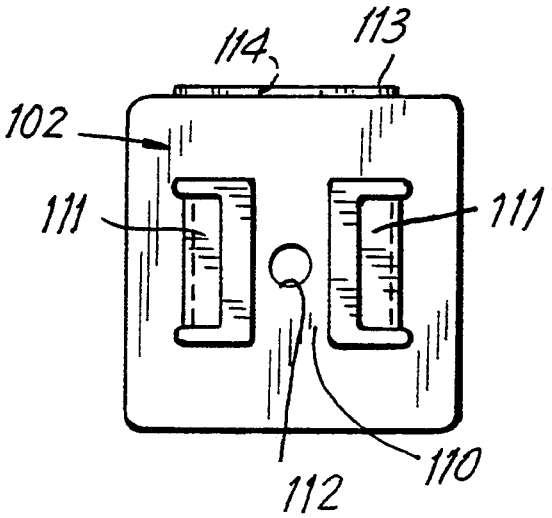
FIG. 17 is a back view showing an additional base member.
Figure 18:
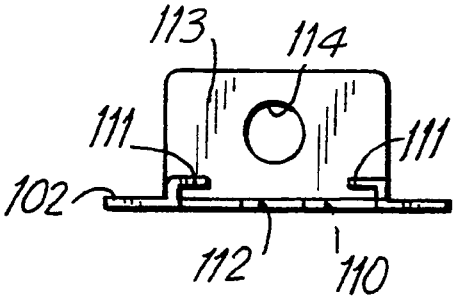
FIG. 18 is a bottom view showing the same additional base member.
Figure 19:
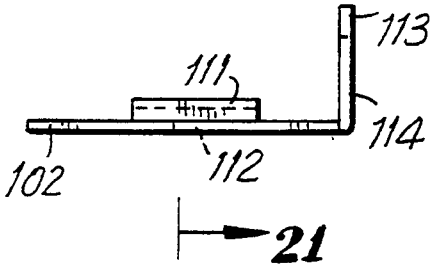
FIG. 19 is a left side view showing the same additional base member.
Figure 20:
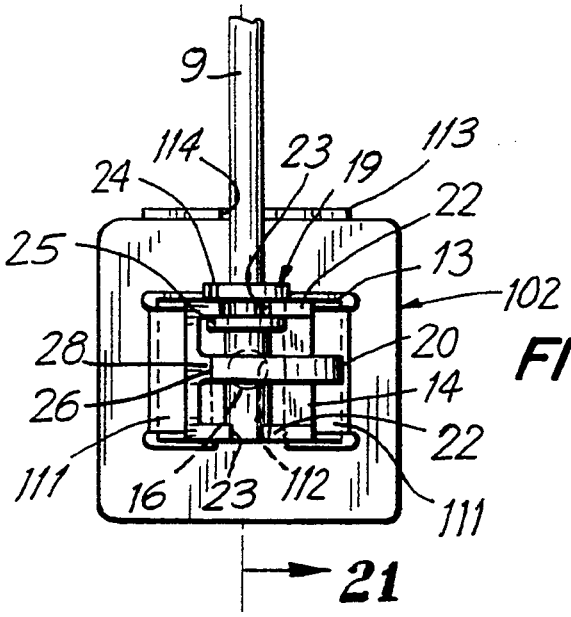
FIG. 20 is a back view showing the same additional base member in use.
Figure 21:
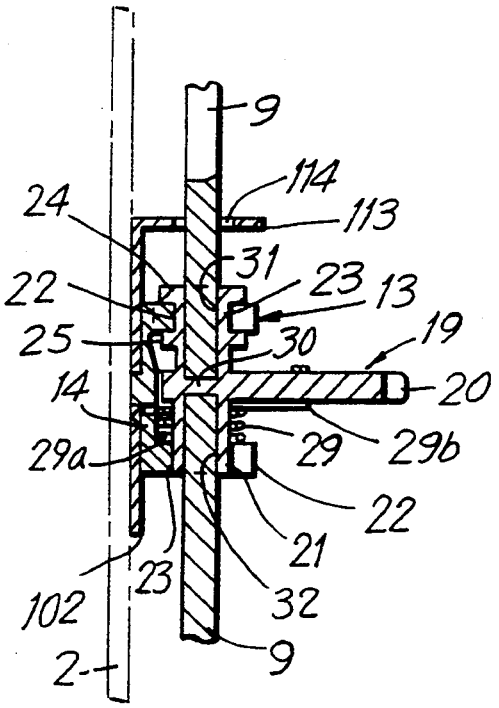
FIG. 21 is a sectional view taken along line 21—21 in FIG. 20.

Designated at 19 is a latch unit having a hook 20, which can be hooked on and unhooked from a counterpart member 18 provided on the side of a frame 17 of the door 1. The latch 19 has a stem having a vertical round bar 21, which is elastically fitted in vertical through grooves 23 formed in an upper and a lower wall 22 of the latch support 13. The vertical round bar 21 has an upper and a lower jaw 24 and 25 engaged with the walls 22 of the latch support 13 (see FIG. 16). The latch 19 is biased by a spring 29 for rotation in the direction of hooking the hook 20 on the counterpart member 18. The vertical round bar 21 of the latch 19 has two, i.e., an upper and a lower, angular holes 31 and 32 defined by a partitioning wall 30. An end portion of the angular drive bar 9 is fitted in the angular holes 31 and 32.

In a different embodiment of the invention, the grip casing 2 can be mounted in one form and also in a transversally reversed form. To this end, the base plate member 2 has four pawl pairs each provided on each end portion of its top and bottom portions, each pawl pair comprising opposed L-shaped pawls 11 on the opposite sides of the intervening portion 10.

In a further embodiment of the invention (see FIGS. 17–21), an additional base member 102 is secured to the door 1 in correspondence to a longer size of the door. The additional base member 102 has a pawl pair provided on its rear surface, the pawl pair having opposed L-shaped pawls 111 sandwiching an intervening portion 110 having a hole 112 extending to the front/rear side of the base member 102. The base member 14 of the latch support 13 has its left and right edge portions fitted in the L-shaped pawls 111 and also has its front central surface engaged with the intervening portion 110. The free end 16 of the tongue portion 15 integral with the base member 14 is elastically fitted in the hole 112 in the intervening portion 110, the vertical round bar 21 of the latch 19 is elastically fitted in the vertical thorough grooves 23 formed in the upper and lower walls 22 of the latch support 13, the upper and lower jaws 24 and 25 of the vertical round bar 21 are engaged with the walls 22 of the latch support 13, and the angular drive bar 9 penetrates the angular holes 31 and 32 of the vertical round bar 21.

In a still further embodiment of the invention, a lock 33 is secured to an intermediate portion of the base plate member 2 (see FIGS. 3–6). The lock 33 has a rotor 34 projecting rearwardly of the base plate member 2. An operating member 35 is secured to the rotor 34 such that it is rotated parallel to the base plate member 2. An intermediate portion of the base plate member 2 has a left and a right rearwardly projecting guide 36 and 37 having transversally through holes 38 and 39 respectively, in which a transversally elongate lock member 40 is slidably fitted. A rear end portion of an interlock pin 43 is fitted in the longitudinal slot 42 of the lock member 40. The operating member 35 has a longitudinal slot 41, in which a front end portion of the interlock pin 43 is fitted. The interlock pin 43 has an intermediate jaw 44 which is clamped between the operating member 35 and the lock member 40. The lock member 40 has a locking portion 45 projecting from its front surface. The locking portion 45 has a transversal locking groove 46 for engagement and disengagement with the drive bar 9.

In operation, by pulling the grip 4 toward the user with finger tips inserted in the grip casing 3, the grip 4 is turned in the clockwise direction about the vertical sleeve-like member 5 against the rotational biasing force of the spring 29. The rotation of the grip 4 is transmitted via the angular drive rod 9 to the latch 19 to cause rotation thereof in the clockwise direction in FIG. 4 about the vertical round bar 21 by the same angle.

With this rotation, the hook 20 of the latch 19 is unhooked from the counterpart member 18 to release the lock of the door 1 to the frame 17. In this state, the door 1 can be opened about a hinge pin (not shown) by further pulling the grip 4 toward the user. By releasing the grip 4 the latch 19, angular drive bar 9 and grip 4 are immediately returned by the biasing force of the spring 29.

By turning the door 1 in the closing direction, at the end of the rotation an inclined cam surface 20*a* of the hook 20 is brought into engagement with the counterpart member 18, thus causing the latch 19 to be rotated tentatively in the clockwise direction for escape. When the door 1 is fully closed so that a notch 20*b* of the hook 20 reaches a position to face the counterpart member 18, the latch 19 is rotated in the counterclockwise direction by the biasing force of the spring 29. Thus, the hook 20 is hooked on the counterpart member 18.

In this state of lock, by inserting a key 69 into a key hole 66 of the lock 33 and turning the rotor 34 in the clockwise direction in FIG. 1, the lock member 40 is displaced to the right via the operating member 35 and interlock pin 43. With this displacement of the lock member 40, the locking groove 46 of the locking portion 45 of the lock member 40 is fitted on the angular drive bar 9 to effect locking thereof against rotation. Thus, the grip 4 is locked against rotation, and the door 1 is locked to the frame 17 regularly.

The latch support 13 has a side wall 27 having a stopper surface 28, which is engaged by a stem surface 26 of the hook 20 of the latch 19 in locked state, with the hook 20 hooked on the counterpart member 18 on the side of the frame 17. It is possible to provide this structure for locking against rotation between the grip 4 and grip casing 3 as well.

When the door grip assembly is used for the right opening type door with the hinge pin on the left side and the counterpart member 18 on the right side, the latch support 13 is fitted in L-shaped pawls 11 of the pawl pair provided on the right side of the base plate member 2 so that the wall 27 is on the right side.

On the other hand, when the door grip assembly is used for the left opening type door with the hinge pin on the left side and the counterpart member 18 on the left side, the latch support 13 is fitted in L-shaped pawls 11 of the pawl pair provided on the left side of the base plate member 2.

The base plate member 2 has a forward/rearward longitudinally elongate angular through hole 47. The grip casing 3 is mounted on the base plate member 2 with the engagement of a mounting flange 48, which is provided on the outer periphery of the front end of the grip casing 3, with the front surface of the base plate member 2 at the edge of the hole 47, the engagement of a front surface 49 of longitudinally elongate box-like left extension 3*a* of the grip case 3 with the rear surface of the base plate member 2 and the elastic engagement of a locking projection 50 at the right side front end of the grip casing 3 with the edge of the hole 47.

A decorative cover 51 is secured by screws 55 to the base plate member 2 its four, i.e., upper and lower, left and right, cylindrical bosses 52 fitted in through holes 53 in the base plate member 2 and via cylindrical spacers 56 and washers 54 fitted on the bosses 52.

The lock 33 is fitted in an oval hole 57 in the base plate member 2 with its front end jaw 59 engaged with the front surface of the base plate member 2 and is secured to the base member 58 by a nut screwed on its outer periphery. Its head portion is present in a lower opening 60 of the cover 51. An inner jaw 62 formed on the surface of an upper opening 61 of the cover 51 is fitted in a front opening 65 of the grip casing 3.

The inner jaw 62 has escape notches 63 and 64. When the grip 4 is pulled toward the front about the vertical sleeve-like member 5, a hand fitting portion 4*a* of the grip 4 enters the notches 63 and 64. When the door grip assembly is used for a right opening type door, the hand fitting portion 4*a* of the grip 4 faces the notch 64 as shown. In the other form of use, that is, in the use for a left opening type door, the hand fitting portion 4*a* of the grip 4 faces the notch 63.

The bearing groove 7 of the grip casing 3 is open on the front side, and the vertical sleeve-like member 5 of the grip 4 is pushed into the bearing groove 7 from the front side of the grip casing 3. In this pushing operation, the wall 6 of the grip casing 3 is elastically deformed such as to open the bearing groove 7, and it is elastically restored when the stem center of the bearing groove 7 and the transversal surface center of the vertical sleeve-like member are brought into coincidence with each other.

The bearing groove 23 of the latch support 13 is open on the rear side, and the vertical round bar 21 of the latch 19 is pushed into the bearing groove 23 from the rear side of the latch support 13. In this pushing operation, the wall 22 of the latch support 13 is elastically deformed such as to open the bearing groove 23, and it is elastically deformed when the stem center of the bearing groove 23 and the sectional surface center of the vertical round bar 21 are brought into coincidence with each other.

The spring 29, which biases the latch 19 for rotation in the locking direction, is a torsion spring. The torsion spring 29 has its coil portion fitted on the vertical round bar 21 of the latch 19, its one straight end portion 29*a* engaged with the base wall 14 of the latch support 13 and its other straight end portion 29*b* engaged with the hook 20. It is possible to use as the bias spring 29 a compression or tension coil spring as well.

The base wall 14 of the latch support 13 has inclined surfaces 14*a* and 14*b* formed in left and right end portions of its upper and lower end portions to facilitate the operation of fitting the wall 14 in L-shaped pawls 11 of the base member 2, or L-shaped pawls 111 of the additional base member 102 (see FIGS. 17–20). In the illustrated embodiment, the L-shaped pawls 11 of the base plate member 2, the L-shaped pawls 111 of the additional base plate member 102 and the guides 36 and 37 of the base member 2 are formed by machining with a press.

A stopper screw 67 screwed in the lock member 35 engages with the inner surface of the guide members 36 and 37 when the locking groove 46 of the locking member 45 is separated from the angular drive bar 9. The additional base member 102 has a raised portion 113 formed with a through guide hole 114 for the angular drive rod 9.

As has been described in the foregoing, the door grip assembly according to the invention comprises the grip 4 having the vertical sleeve-like member 5 elastially fitted in the bearing grooves 7 of the grip casing 3, and also having increased diameter portions 5*a* engaged with the walls of the grip casing 3, the angular drive bar 9 inserted through the angular through bore 8 of the vertical sleeve-like member 5, the latch support 13 having the base 14 fitted in opposed L-shaped pawls 11, sandwiching the intervening portion 10, in one of the pawl pairs each provided on each end of the top and bottom portions of the base plate member 2, the front central portion of the base 14 being engaged with the intervening portion 10, the base 14 having the integral tongue portion 15 having the end projection 16 elastically fitted in the hole 12 of the intervening portion 10, the vertical round bar 21 having the upper and lower jaws 24 and 25 engaged with the wall portions 22 of the latch support 13, and the vertical round bar 21 provided with the upper and lower angular holes 31 and 32 defined by the partitioning wall 30, the opposite ends of the angular drive bar 9 being fitted in the angular holes 31 and 32. Thus, there is no need of locking the vertical sleeve-like member 5 of the grip 4, the vertical round bar 21 of the latch 19 and the angular drive bar 9 with an E or C-shaped ring or a locking pin, and also there is no need of locking the latch support 13 to the base plate member 2 with the screw. Thus, it is possible to greatly simplify the assembling of the door grip assembly and reduce the cost of manufacture.

Further, the grip casing 3 can be mounted in one form and also in the transversally reversed form on the base member 2, so that the door grip assembly according to the invention can be directly used for a right opening type door, in which the hinge pin is provided on the left side while the counterpart member of the frame is on the right side, and also for a left opening type door, in which the hinge pin is provided on the right side while the counterpart member of the frame is on the left side, by merely selecting the way of assembling.

Further, unlike the prior art in which exclusive door grip assemblies are manufactured independently for the left and right opening type doors, the manufacturing cost reduction can be obtained owing to mass production of a single type of door grip assemblies, and it is possible to reduce the shelf space, dispense with the check of the type when selling the door grip assembly, and eliminate erroneous delivery.

Further, since the additional base member 102 is provided, which has a pawl pair of opposed L-shaped pawls 111 sandwiching the intervening portion 110, the lock of the door 1 by the hook 20 and the counterpart member 18 can be obtained at a desired number of positions spaced apart at a desired interval by securing one or more additional base members 102 to the door 1 in dependence on the size of the door 1.

Further, the door grip assembly according to the invention further comprises the lock 33 secured to the base plate member 2 and having the rotor 34, the operating member 35 secured thereto, the lock member 40 inserted in the through holes 38 and 39 formed in the left and right guides 36 and 37 projecting from the base plate member 2, and the interlock pin 43 coupling the operating member 35 and lock member 40 to each other, the operating member 35 being capable of being slidably displaced to the left or right by the key 67 inserted in the lock 33 to cause engagement and disengagement of the angular drive bar 9 with respect to the locking groove 46 of the locking member 45 of the lock member 40. Thus, the door 1 having been locked by the engagement between the counterpart member 17 and hook 20 may, if necessary, be locked with respect to the frame regularly.

Further, the interlock pin 43 is locked by inserting its front end in the slot 41 of the operating member 35, inserting its rear end in the slot 42 of the lock member 40 and clamping its intermediate jaw 44 between the operating member 34 and lock member 40. Thus, there is no need of securing any locking disk to the interlock pin with a screw or deforming and enlarging an end portion of the interlock pin by additional tightening. It is thus possible to save the cost of manufacture of the door grip assembly. In addition, there is no possibility of forming the operating member and lock member with any bevel with excessive tightening, thus ensuring smooth operation of the interlock pin 43.

What is claimed is:

1. A door grip assembly for a door comprising:

a grip casing secured to a base plate member which may be secured to a door rear surface;

a grip having a vertical sleeve-like member elastically fitted in each of two bearing grooves, each said bearing groove being formed in an upper and a lower wall portion of said grip casing, said vertical sleeve-like member having opposite end increased diameter portions engaged with said upper and lower wall portions;

an angular drive bar inserted through a vertical angular bore formed in said vertical sleeve-like member, said base plate member having two pawl pairs each provided on each end of a top and a bottom portion of the base plate member rear surface, each said pawl pair consisting of opposed L-shaped pawls sandwiching an intervening portion having a through hole;

a latch support having a base member having left and right edge portions fitted in said opposed L-shaped pawls and also having a front central surface engaged with said intervening portion, said base member having an integral tongue portion having an end projection elastically fitted in said hole in said intervening portion;

a latch having a hook capable of being hooked on and unhooked from a counterpart member on a frame of the door, said latch having a stem having a vertical round bar elastically fitted in vertical through grooves formed in an upper and a lower wall portion of said latch support, said vertical round bar having an upper and a lower jaw engaged with said wall portions of said latch support, said hook being biased by a spring for rotation in a direction for hooking of said hook on the counterpart member, said vertical round bar of said latch having an upper and a lower angular hole defined by a partitioning wall, opposite ends of said angular drive bar being fitted in said angular holes.

2. The door grip assembly according to claim 1, wherein said grip casing is capable of being mounted either in one form or in a transversally reversed form on said base plate member.

3. The door grip assembly according to claim 1, which further comprises an additional base member secured to the door corresponding to the size of the door, said additional base member having a pawl pair consisting of opposed L-shaped pawls sandwiching an intervening portion having a through hole, said latch support including a base portion having left and right edge portions fitted in said opposed L-shaped pawls and also having a front central surface engaged with said intervening portion, said base portion having an integral tongue portion having an end projection elastically fitted in said hole in said intervening portion, said vertical round bar of said latch being elastically fitted in vertical through grooves formed in said upper and lower wall portions of said latch support, said upper and lower jaws of said vertical round bar being engaged with said wall portions of said latch support, said angular drive bar being fitted in said angular holes.

4. The door grip assembly according to claim 1, which further comprises a lock secured to an intermediate portion of said base plate member and projecting rearwardly of said base plate member, an operating member secured to a rotor such as to be rotated parallel to said base plate member, a left and a right rearwardly projecting guide having transversally through holes, a traversal elongated lock member slideably fitted in said traversal through holes, and an interlock pin having a front end portion fitted in a longitudinal slot of said operating member, a rear end portion fitted in a longitudinal slot of said operating member and an intermediate jaw clamped between said operating member and said lock member, said lock member having a locking portion projecting from its front surface, said locking portion having a transversal locking groove for engagement and disengagement with respect to said angular drive bar.

5. The door grip assembly according to claim 2, which further comprises an additional base member secured to the door corresponding to the size of the door, said additional base member having a pawl pair consisting of opposed L-shaped pawls sandwiching an intervening portion having a through hole, said latch support including a base portion having left and right edge portions fitted in said opposed L-shaped pawls and also having a front central surface engaged with said intervening portion, said base portion having an integral tongue portion having an end projection elastically fitted in said hole in said intervening portion, said vertical round bar of said latch being elastically fitted in vertical through grooves formed in said upper and lower wall portions of said latch support, said upper and lower jaws of said vertical round bar being engaged with said wall portions of said latch support, said angular drive bar being fitted in said angular holes.

6. The door grip assembly according to claim 2, which further comprises a lock secured to an intermediate portion of said base plate member and projecting rearwardly of said base plate member, an operating member secured to a rotor such as to be rotated parallel to said base plate member, a left and a right rearwardly projecting guide having transversally through holes, a transversal elongated lock member slideably fitted in said transversal through holes, and an interlock pin having a front end portion fitted in a longitudinal slot of said operating member, a rear end portion fitted in a longitudinal slot of said operating member and an intermediate jaw clamped between said operating member of said lock member, said lock member having a locking portion projecting from its front surface, said locking portion having a transversal locking groove for engagement and disengagement with respect to said angular drive bar.

7. The door grip assembly according to claim 3, which further comprises a lock secured to an intermediate portion of said base plate member and projecting rearwardly of said base member, an operating member secured to a rotor such as to be rotated parallel to said base plate member, a left and a right rearwardly projecting guide having transversal through holes, a transversal elongated lock member slideably fitted in said transversal through holes, and an interlock pin having a front end portion fitted in a longitudinal slot of said operating member, a rear end portion fitted in a longitudinal slot of said operating member and an intermediate jaw clamped between said operating member and said lock member, said lock member having a locking portion projecting from its front surface, said locking portion having a transversal locking groove for engagement and disengagement with respect to said angular drive bar.

* * * * *